US010051981B2

(12) United States Patent
Welch

(10) Patent No.: US 10,051,981 B2
(45) Date of Patent: Aug. 21, 2018

(54) PICTURE FRAME AND SYSTEM AND METHOD OF CONSTRUCTION THEREOF

(71) Applicant: Conservation By Design Limited, Bedford, Bedfordshire (GB)

(72) Inventor: Stuart Welch, Riseley (GB)

(73) Assignee: CONSERVATION BY DESIGN LIMITED (GB)

( * ) Notice: Subject to any disclaimer, the term of this patent is extended or adjusted under 35 U.S.C. 154(b) by 395 days.

(21) Appl. No.: 14/442,982

(22) PCT Filed: Nov. 14, 2013

(86) PCT No.: PCT/GB2013/053000

§ 371 (c)(1),
(2) Date: Sep. 14, 2015

(87) PCT Pub. No.: WO2014/076478

PCT Pub. Date: May 22, 2014

(65) Prior Publication Data

US 2015/0297001 A1 Oct. 22, 2015

(30) Foreign Application Priority Data

Nov. 15, 2012 (GB) ..... 1220527.4

(51) Int. Cl.
*A47G 1/06* (2006.01)
*B44D 7/00* (2006.01)

(52) U.S. Cl.
CPC ..... *A47G 1/0605* (2013.01); *A47G 1/0633* (2013.01); *B44D 7/00* (2013.01)

(58) Field of Classification Search
CPC ..... A47G 1/06; A47G 1/0616; A47G 1/16; G09F 1/12; G09F 15/0012; G09F 15/0018; B44C 5/02
See application file for complete search history.

(56) References Cited

U.S. PATENT DOCUMENTS 1,048,343 A * 12/1912 Rice ..... G09F 7/08 250/463.1
3,161,975 A * 12/1964 McMillan ..... A47G 1/06 40/718

(Continued)

FOREIGN PATENT DOCUMENTS

DE 7416216 U 8/1975
FR 2258154 1/1974

(Continued)

OTHER PUBLICATIONS

GB Search Report of corresponding application GB 1220527.4, dated Mar. 14, 2013, Intellectual Property Office.

(Continued)

*Primary Examiner* — Cassandra H Davis
(74) *Attorney, Agent, or Firm* — Great Lakes Intellectual Property, PLLC

(57) ABSTRACT

A picture frame is constructed using a system and method wherein a pair of cooperating profile extrusion lengths are cut to size to form a frame to accommodate a piece of artwork. A continuous spacer is provided to be locatable between a cover sheet and backing sheet. The profile lengths are fastened together at the edges of the frame, thereby compressing the spacer between the cover sheet and backing sheet. As such an isolated volume is created that can be evacuated of oxygen for preservation of the artwork.

20 Claims, 6 Drawing Sheets

(56) References Cited

U.S. PATENT DOCUMENTS

| | | | | |
|---|---|---|---|---|
| 4,033,452 | A | 7/1977 | Therrien | |
| 4,794,714 | A * | 1/1989 | Weisgerber | A47G 1/0605 40/735 |
| 5,125,175 | A | 6/1992 | Huff | |
| 5,205,059 | A | 4/1993 | Doll | |
| 5,815,971 | A | 10/1998 | Rothe | |
| 7,146,759 | B2 * | 12/2006 | Bell | A47G 1/065 40/734 |
| 2003/0029069 | A1 | 2/2003 | Vihos | |
| 2007/0062087 | A1 | 3/2007 | Ross | |

FOREIGN PATENT DOCUMENTS

| | | |
|---|---|---|
| WO | WO00/19869 | 4/2000 |
| WO | WO2006/024045 | 3/2006 |
| WO | WO2008/057059 | 5/2008 |

OTHER PUBLICATIONS

International Search Report of corresponding application PCT/GB2013/053000, dated Jan. 22, 2014, European Patent Office acting as International Searching Authority.

* cited by examiner

PICTURE FRAME AND SYSTEM AND METHOD OF CONSTRUCTION THEREOF

CROSS-REFERENCE TO RELATED APPLICATIONS

This application is the U.S. national phase of PCT international application number PCT/GB2013/053000 filed Nov. 14, 2013, which claims priority to United Kingdom application GB 1220527.4 filed Nov. 15, 2012, the disclosures and benefits of which are incorporated in their entireties by reference herein.

TECHNICAL FIELD

The present invention relates to a picture frame and its system/method of construction; more particularly, a picture frame that protects works of art from environmental "ageing" effects.

BACKGROUND TO THE INVENTION

Works of art, such as paintings, are usually stored and displayed in the open air which includes oxygen. It is well known that exposure to oxygen leads to deterioration of most materials over time by oxidation and hydrolysis. Deterioration is also associated with light exposure, thus paper-based works of art are often only put on open display for limited periods.

In actual fact, for light to contribute to the deterioration of a material, oxygen is required to be present. Therefore, an oxygen free (or controlled) environment will result in reduced deterioration, even in the presence of light.

Sealed enclosures that house a work of art in a low or zero oxygen environment are known. However, such enclosures are usually expensive to build because each must be custom-made for the situation.

WO2008/057059 describes a system of extruded profiles that connect together, intended for housing an advertising poster. However, the profiles generally connect by a hinged clip arrangement which is unsuitable for providing an air-tight seal as needed for an artwork. There is insufficient compression to maintain a seal.

DETAILED DESCRIPTION OF THE INVENTION

Figure 1:
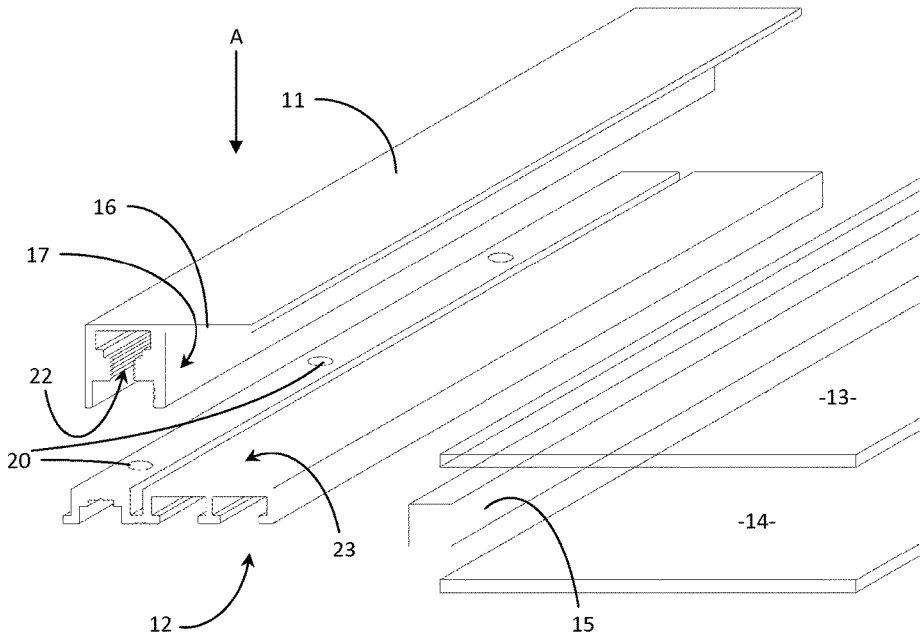
FIG. 1 illustrates the main components of a system of constructing a picture frame according to the invention.

The present invention seeks to provide a modular system of protective picture frame assembly that will enable controlled atmosphere enclosures to be constructed at reduced cost. Such a system not only has application in art galleries and museums, but also private collections.

In one form there is a provided a system of constructing a picture frame, including:

- cutting to size a profile length to form a frame of a required dimension;
- providing a cover sheet to fit within the frame;
- providing a backing sheet to fit within the frame;
- providing a continuous spacer locatable between the cover sheet and backing sheet to form a border within which an article can be mounted; and
- compressing the spacer between the cover sheet and backing sheet by means of a fastener disposed into the profile length, at an edge of the frame.

In one example there are a pair of cooperating profile lengths forming the frame wherein the fastener secures the profile lengths together, sandwiching the cover sheet, spacer and backing sheet therebetween. In an alternative embodiment there is only one profile piece which comprises the frame.

Fastening is performed by a plurality of threaded fasteners, such as a screws/bolts, arranged around the edge of the frame providing an axial compression force against either one or both of the cover or backing sheet or to adjustably fasten the two profile lengths together.

The profile length(s) include flange surfaces that overlap against the cover sheet and backing sheet respectively. Preferably the spacer, which operates as a seal, is hidden underneath the overlap of a (first) profile length such that it is not visible when viewed frontally through the cover sheet.

Preferably the profile lengths are cut with mitred ends to form the frame shape. At least one of the profiles may include a receiving means for receiving a corner joining element such that the frame can be held together.

As mentioned, in the case of two mating profiles, the profile lengths are able to be fastened together by a suitable means. In one form the profiles are fastened by a screw, bolt or equivalent which provides a compression force to sandwich the spacer between cover and backing sheets. The screw head may be accessible from either the "first" profile (adjacent the cover sheet) or the "second" profile (adjacent the backing sheet).

In the expected most practical form of the invention the profile length(s) are intended to be extrusions, e.g. of aluminium or plastic. However, the profiles could be wooden or formed by other processes, other than strictly extrusion. The benefit of an extrusion is that it gives a consistent profile which will provide mating surfaces between the components, and can be cut to length as required.

As with most picture frames the same profile shape (or, in the preferred embodiment, pair of profile shapes) is intended to be used for all four sides of the rectangular/square shape. However, it is not inconceivable that additional profiles could be utilised for left/right, top/bottom sides etc. Furthermore, the profile may be curved, which thereby falls within the definition of "length" according to the invention, in order for a circular, elliptical or combination straight/curved frame to be constructed.

In one form the first profile length includes a means for receiving a veneer strip/plate to provide a customised appearance for the frame once assembled. Such a veneer can also hide fasteners (i.e. screw or bolt heads) that are frontally accessible.

The "continuous" spacer is preferably a compressible seal material although it may be a composite of a solid spacer with two seal faces that is sandwiched between the cover and backing plates.

The spacer must conform to the rectangular or other shape of the assembled frame and so must provide for having suitable corners. Corners could be formed by suitable flexibility, being cut and re-sealed at a right-angle, or the entire seal shape being cut from a sheet material. The term "continuous" spacer within the meaning of the invention is thus the quality of being a closed shape when installed in the picture frame. The seal/spacer may be supplied in a non-continuous state and later adhered into a closed shape. In some forms an additional seal of the same or different material may be included, i.e. providing a two or more seal walls at the internal edge of the frame.

In practice it will be apparent that the picture frame is constructed according to a method wherein:

- a work of art is measured;
- cover and backing sheets are produced according to the measurement such that each is at least slightly larger than the artwork dimensions;
- cover and backing sheets are placed over the front and rear of the artwork;
- a continuous seal is located around the entirety of an outside edge of the artwork, said continuous seal being in contactable with a planar surface of both the cover sheet and the backing sheet;
- lengths of at least one profile length are cut for forming a frame around the cover sheet and backing sheet;
- profile lengths are engaged with the edges of the cover and backing sheets respectively and fastening means are employed to compress the continuous seal located between the cover sheet and backing sheet, thereby isolating the artwork therein from the outside atmosphere.

In one example there are a mating pair of profile lengths and the fastening means is employed between the pair of mating profile lengths to compress them together. In an alternative embodiment there is a single profile for receiving fastening means that engage directly with either or both of the cover or backing sheet for compressing the continuous seal.

According to both the method and system described herein, preferably an oxygen reduction agent or means is provided to reduce the concentration of oxygen in the volume occupied by the artwork. In one form this is a scavenger material placed in the internal volume prior to seal compression. Such a material is usually supplied in a sachet in granulated form. Where oxygen is to be removed in such a way, a pressure equalising diaphragm may be incorporated into the backing sheet, in order for the lost volume from removed oxygen to be accounted for.

In an alternate form a valve may be installed in the backing sheet (or conceivably through the spacer) such that an inert gas, e.g. Argon or specifically formulated gas (optimised for artwork storage conditions) can be introduced.

The main components of a picture frame according to one embodiment of the invention are illustrated by FIG. 1. Particularly, an outer frame is comprised of a first profile length 11 that fits into and mates with a second profile length 12 that, together, surround and secure a frontal (transparent) cover sheet 13 and a backing sheet 14. Between the cover sheet 13 and backing sheet 14 a spacer/seal element 15 is located which will define an internal volume (26) between the sheets 13/14 within which a work of art, e.g. a painting, is able to be housed (not illustrated).

Figure 2:
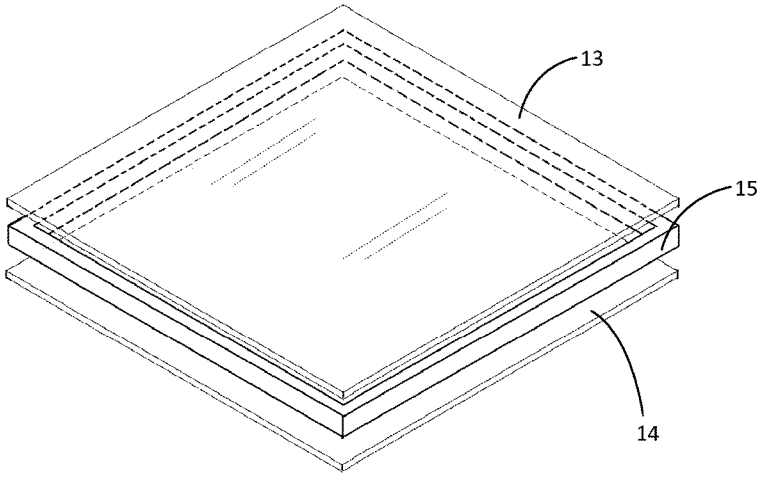
FIG. 2 illustrates more detail of a cover sheet, spacer element and backing sheet according to the invention.

FIG. 2 shows a general view of the proposed configuration of the spacer/seal 15 and its location between the cover sheet 13 and backing sheet 14. Particularly, spacer 15 should be a continuous length such that, in the final assembly, the volume (26) defined between the sheets is sealed from the external atmosphere. Seal 15 may be a single piece of resilient material or a composite of several layers, such as a hard core and resilient outer faces.

Figure 3:
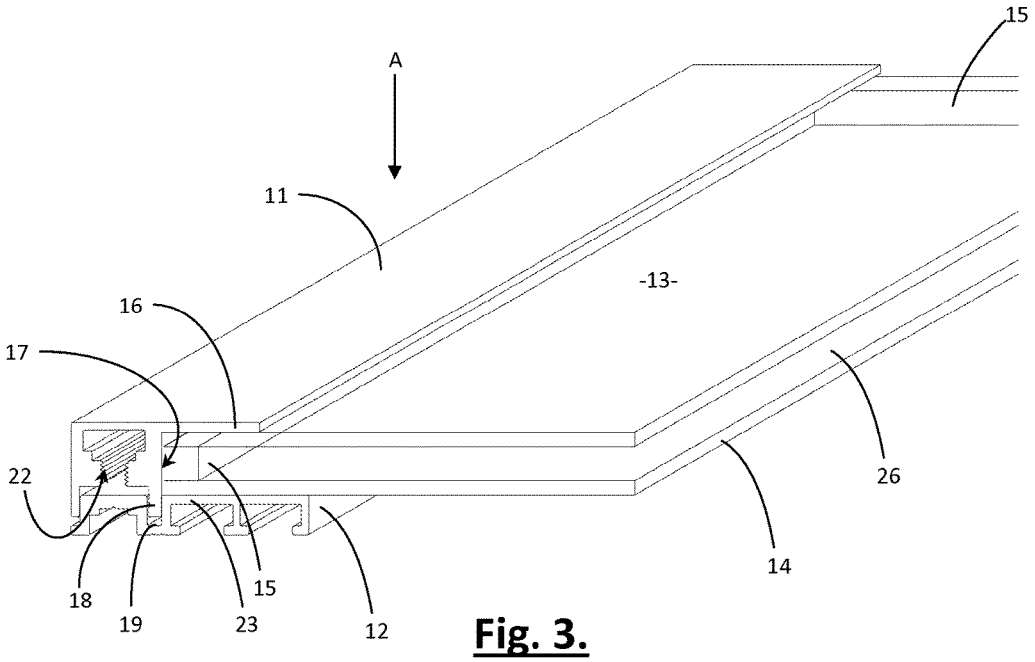
FIG. 3 illustrates an assembled cross-section view based on the components from FIG. 1.

FIG. 3 shows the components from FIG. 1 in an assembled cross-section form where it can be seen that the spacer 15 is effectively "hidden" (when viewed from a frontal perspective indicated by arrow A) behind a flange 16 of the first profile length 11. Preferably, both sheets 13 and 14 are of an equivalent size and abut against a channel-like surface 17 of first profile length 11, perpendicular to flange 16.

According to the assembled view shown by FIG. 3, it will be apparent that a mating flange 18 extending from the abutting surface 17 is received by a channel 19 formed in the second profile length 12. This mating arrangement serves to locate the profile lengths relative to one another for simple assembly. It is noteworthy that a small gap is generally allowed between the channel 19 and mating flange 18 to allow for variations in the combined thickness of the cover sheet+spacer+backing sheet; and also to allow for compression of the spacer/seal 15.

As best seen in FIG. 1, second profile length 12 may include a series of through-holes 20 that allow for the placement of screws/bolts 21 (see FIGS. 5 and 6) that fasten the profile lengths 11/12 together securely. The provision of screws/bolts/nuts etc. may be achieved in several ways; for example, the illustrated embodiment of FIGS. 1 and 3 features a channel 22 within profile length 11 that is formed with a toothed edge (linear thread) for receiving the thread of a screw etc.

It will be apparent that a number of alternative fastening methods could be utilised to affix the profile lengths together. However, it is preferable that any fastening means allows for an adjustment of the compression force applied via flange 16 and the opposing surface 23 of the respective profile lengths 11 and 12.

Figure 4:
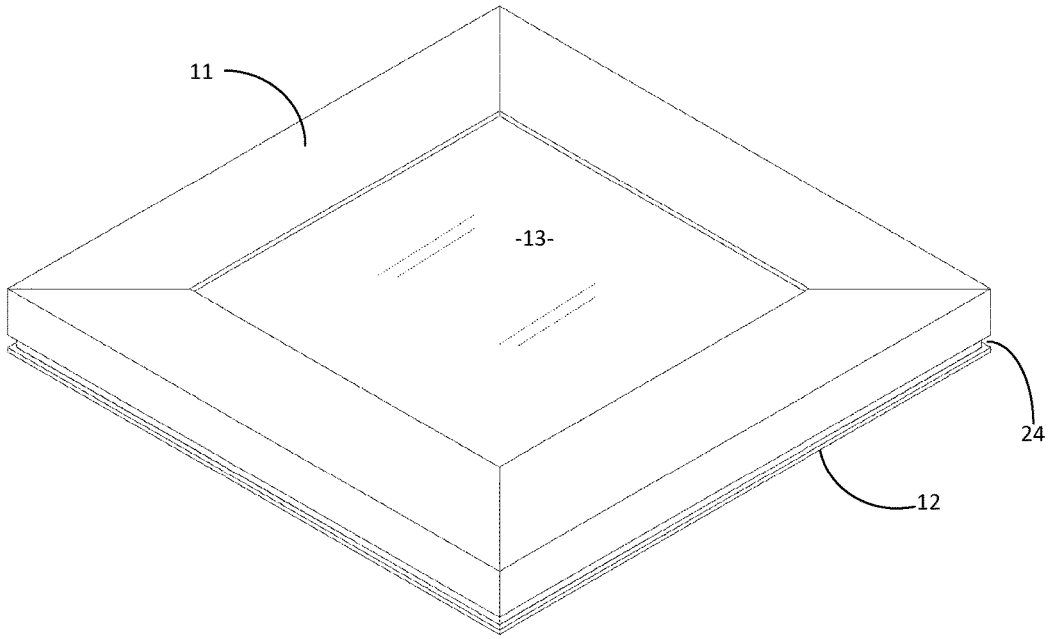
FIG. 4 illustrates a general view of the total assembled picture frame according to the invention.

Referring to FIG. 4, it is intended that the pair of profile lengths 11/12 which, in practice, are most preferably aluminium extrusions or similar, will have mitred ends such that four (4) pairs of extrusions are fitted together to form a square frame. Of course, it is possible that the frame could have any geometric shape made possible by a suitable mitre angle, or incorporate curved profile lengths, still with the same general cross section shown by FIGS. 1 and 3.

FIG. 4 illustrates an exposed gap 24 between mating flanges of the first and second profile lengths. Such a gap allows additional compression force to be applied (in the same way as the gap between channel 19 and flange 18 described above), however, if the compression requirements and manufacturing tolerances can be tightly controlled then such a gap could be minimised to a negligible distance.

Figure 5:
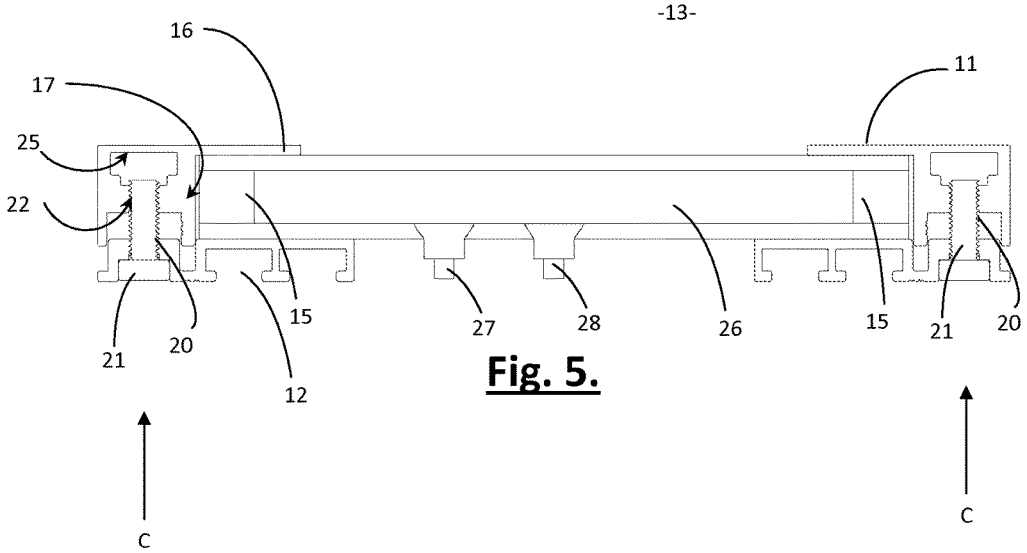
FIG. 5 illustrates a side elevation section view of one embodiment of the picture frame according to the invention.

FIG. 5 illustrates a cross-section view during assembly of a picture frame according to the invention. Particularly, a screw/threaded member 21 is shown engaged through holes 20 and into the threaded channel 22 of the first profile length 11. In other embodiments a nut (which could be spring loaded against an internal surface 25 of the first profile length) may be present to receive the screw thread and provide a more secure fastening. It will be apparent that, as the screw thread is tightened in the direction of arrow C, the mating flange/channel arrangement of the first and second profile brings the components together and compresses spacer/seal 15. When all four sides of the cover/backing sheets are compressed, enclosing the seal therebetween, this results in a sealed volume 26 within which a painting or the like can be housed.

In practice, it will be necessary to modify the atmosphere within volume 26 to create conditions that are favourable to the preservation of artwork. Manipulation of the internal environment can be achieved, for example, by use of appropriate input and output valves 27 and 28 respectively, through which a gas can be introduced (input valve 27) to flush out (output valve 28) the prevailing atmosphere. The gas may be inert such as Argon or another mixture specifically formulated for optimal preservation. Such a formulated gas may in fact include a small component of oxygen if deemed necessary. Gas of either type can be supplied in a pressurised container. The invention may also provide for control of the humidity of the gas occupying volume 26.

Figure 6:
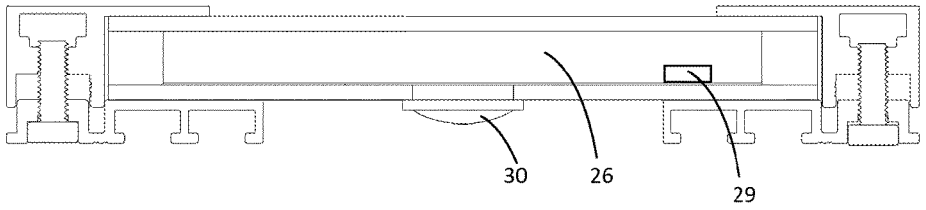
FIG. 6 illustrates a side elevation section view of an alternative embodiment of the picture frame according to the invention.

FIG. 6 illustrates the same general components as FIG. 5 but wherein the mechanism for replacing/modifying the atmosphere involves the use of a scavenger material 29 located within the volume 26. The scavenger material will remove all or most of the oxygen from the volume 26 which, in practice, results in a reduced pressure in volume 26 since the normal atmosphere comprises 21% oxygen. To account for the reduced pressure and avoid undue stress on the cover or backing sheet, a diaphragm 30 is installed which will "pop" inwards as the amount of oxygen is decreased. Scavenger material 29 is typically supplied in granulated form, within a small sachet, but other forms may be possible or become available.

Figure 13:
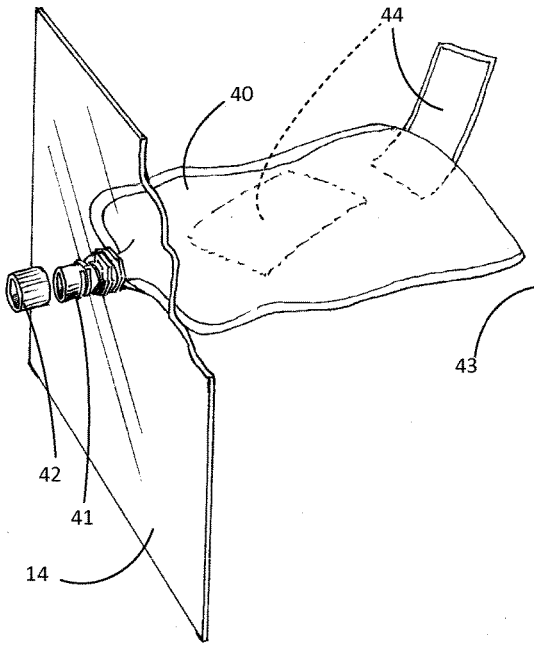
FIGS. 13 to 15 illustrate an oxygen scavenging arrangement.
Figure 14:
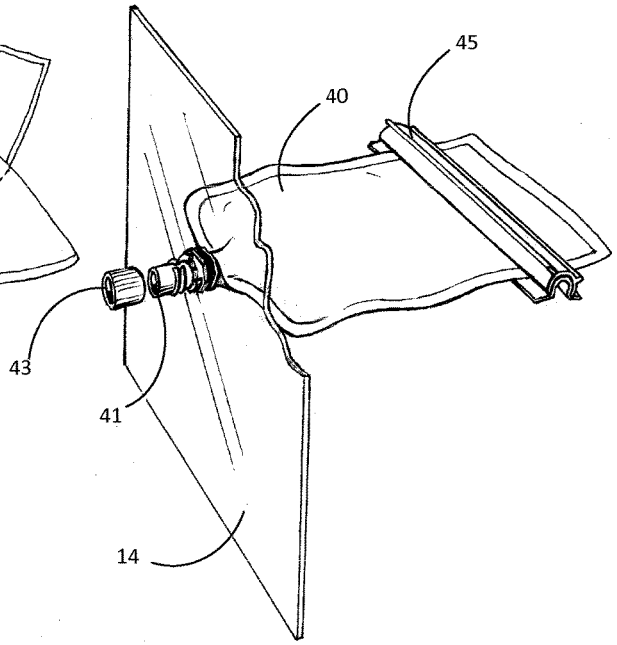
Figure 15:
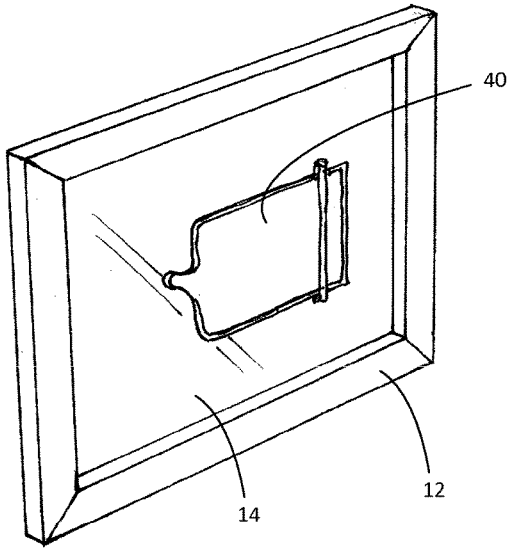

For example, an alternative to the diaphragm described above is the use of a flexible, heat sealable oxygen and moisture barrier bag 40 as illustrated in FIGS. 13 to 15. Such a bag could be fixed to the back of the frame or backing sheet 14 and acts as a bellows to counteract any contraction or expansion caused by the removal of oxygen by the oxygen scavengers or the expansion and contraction of the air caused by changes in temperature. This flexible bag 40 can also be used as an external housing for the oxygen scavengers.

A suitable bag 40 is commonly made from a multi-layer composite of polyester, aluminium foil and heat sealable polyethylene; often found as a flexible drinks container or blood bag. One end of the bag has a hard plastic nozzle 41 which has a moulded screw thread onto which a cap 42 is screwed to close the bag. In the present context a hole will be made in the backing sheet 14 of the frame for the nozzle to pass through. It will be fixed in place with the plastic screw cap 42 which preferably has a hole 43 in it to allow airflow so that the scavenger can react with the oxygen with in the frame. The nozzle is preferably sealed in place with butyl rubber or a similar oxygen barrier sealant to prevent leakage.

In one form the other end of the bag 40 is open to allow the scavenger sachet 44 to be placed/re-placed into the bag. Once the oxygen scavenger 44 has been inserted into the open end (FIG. 13), the bag can be closed using a plastic compression clip 45 (FIG. 14). Use of the clip 45 could be temporary, followed by a permanent heat sealing of the bag behind the plastic clip using an impulse heat sealer or other suitable heat sealing equipment.

FIG. 15 illustrates the rear of an assembled frame where bag 40 is accommodated behind the backing sheet 14.

Figure 7:
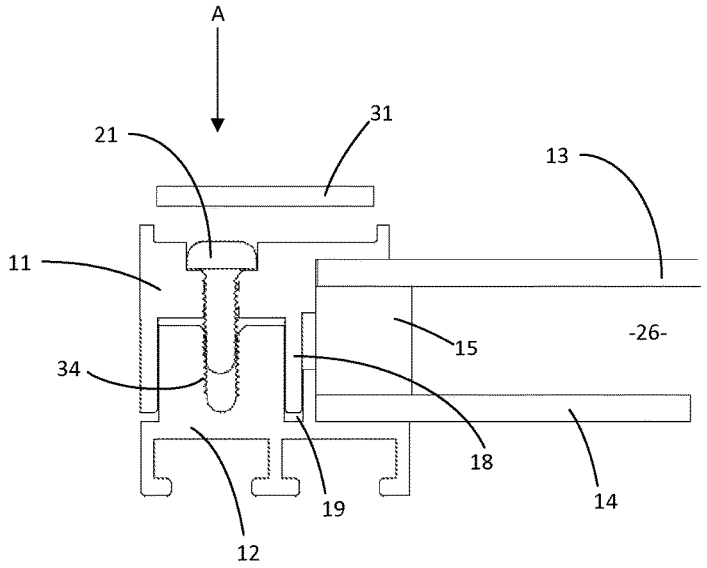
FIG. 7 illustrates a detailed section view of one side of the picture frame according to the invention featuring a veneer.

FIG. 7 illustrates an alternative arrangement of first and second profile lengths wherein a screw 21 is introduced via the front of the picture frame, i.e. via first profile 11. The receiving thread 34 for the screw 21 is therefore formed (which could be discreet holes or a channel) in the second profile length 12. A similar guiding flange 18/channel 19 arrangement is utilised for locating the relative components as that illustrated in the embodiment of FIGS. 1 to 6.

Since, according to FIG. 7, the screw 21 may otherwise be visible from the front of the picture frame in the direction of arrow A, it is preferable to provide a veneer 31 that can be located and/or set into the visible surface of first profile length 11 and its extending flange 16. Of course, in alternative forms, the "industrial look" of exposed screw heads may be desirable. This embodiment is useful for enabling frontal access to adjust compression and also to access the artwork itself without necessarily dismounting the entire frame from a wall, i.e. the rear frame (12) may remain mounted while an artwork is within the frame is substituted.

It will be apparent from FIG. 7 that the compression effect on seal 15 and the creation of an isolated volume 26 is otherwise the same as previous embodiments.

Figure 8:
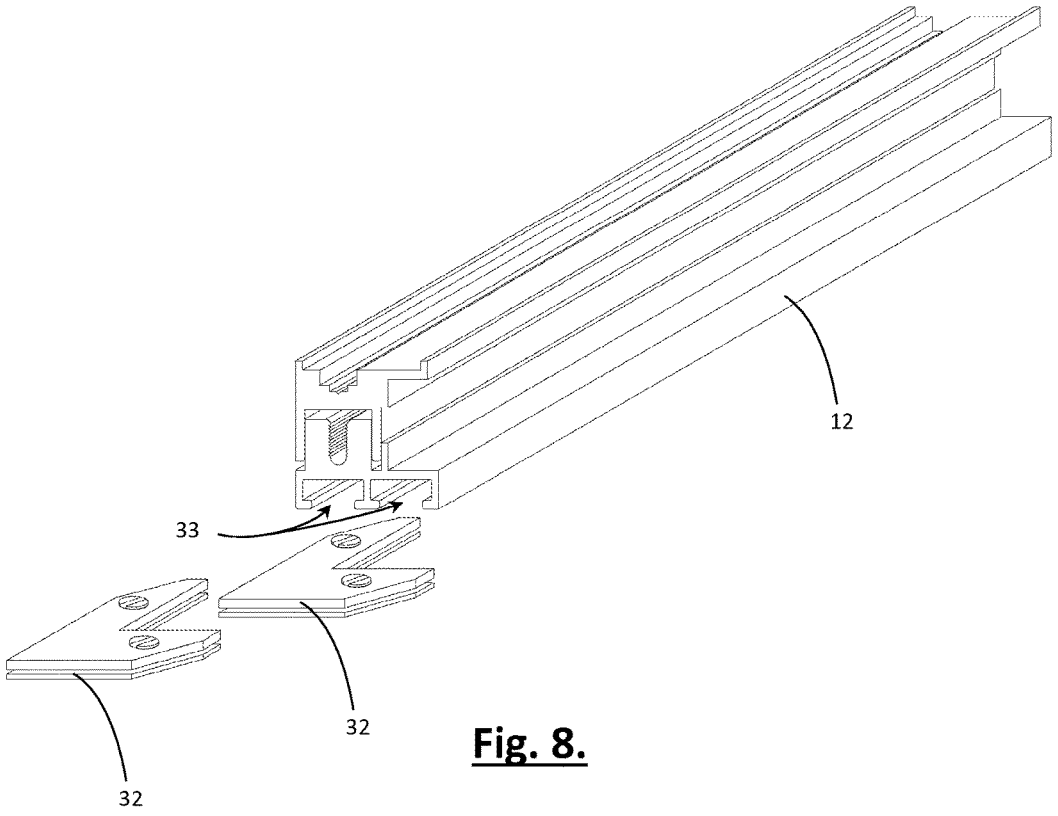
FIG. 8 illustrates a general view of the section from FIG. 7, further showing corner joint elements.

FIG. 8 illustrates a general view of the cross-section from FIG. 7, i.e. with provision for a fastening means to be introduced from the front of the picture. Corner joining elements 32 are further illustrated that are intended to be received by a channel 33 formed in the underneath/rearside of second profile length 12. It will be apparent that when the profile lengths are mitred as previously mentioned (and illustrated in FIG. 4) that the corner joining elements 32 will be able to securely join at least adjacent second profile lengths 12 together to construct a total picture frame shape. Preferably each corner element 32 has a screw incorporated therein that can extend and engage with a surface of channel 33 to provide a secure join. Such joining methods are known in the art of picture frame construction.

As previously mentioned, the first and second profile lengths are preferably extrusions of aluminium or another suitable material such as plastic. Likewise, other components may be made of any suitable material which is fit for purpose. Particularly, the spacer/seal 15 is intended to be a continuous piece such that it maintains the integrity of the internal/isolated volume 26. This may be achieved by laser cutting a square or other appropriate seal shape as illustrated in FIG. 2 from a single sheet of material. Alternatively, the seal may have a tubular cross-section and be manipulated into place at the peripheral edges of the opposing sheets 13/14 by virtue of its inherent flexibility. A further method is to cut and seal mitred ends of an extruded seal length. Examples of seal material may be butyl rubber, clay, wax, Viton® or a mixture of these.

A yet further method of construction is to utilise a delivery device or caulk sealant "gun" to deposit a flowable material (of oxygen barrier material such as butyl rubber or Viton®) in a suitable closed shape at the edges of either the cover or backing sheet prior to assembly. Sufficient control of sealant discharged from the nozzle of a sealant gun would be required to ensure an appropriate width and height amount, however, the accuracy of delivery has some flexibility due to the fact that the edges of cover/backing sheets are hidden by the frame. In other words the sealant does not have to be a perfect shape, so long as the seal is complete.

Preferably, an edge surface of the cover/backing which is to receive the sealant will first have a vacuum grease or other release agent (e.g. Vasoline®) applied in order to facilitate removal upon disassembly at a later time. The sealant itself, e.g. butyl rubber, should preferably be allowed to cure before the planar cover/backing sheets are sandwiched together, and subsequently secured by the frame and/or adjustable fastening means.

The profile lengths are ideally intended to fit together in a relatively slim overall configuration such that the artwork will not be too bulky hanging on a wall. However, profile dimensions and the sandwiched seal component can be modified to accommodate any size/thickness of artwork, including an entire conventional picture frame therewithin.

As an alternative to modifying the mating profile and corresponding seal thickness it is possible to form the backing plate to have a recess that will accommodate a substantive outline/depth of the artwork. This approach avoids changing the moulded/extruded components and only requires a change to the back (or front) plate which could be made from a vacuum formed/pressed sheet or other simple process.

Figure 9:
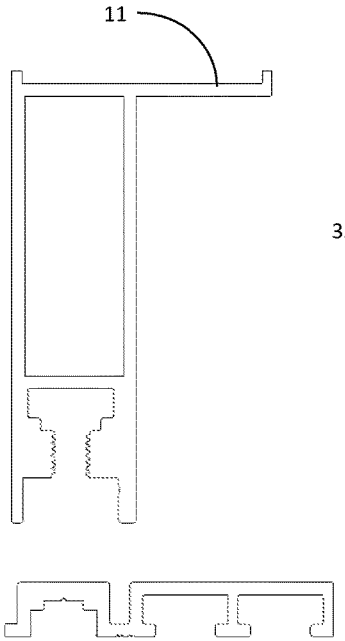
FIG. 9 illustrates an alternative profile section.

However, greater thicknesses of artwork (or cover/back sheet made of bulletproof glass for example) can be accommodated by simply modifying either or both profiles as illustrated by FIG. 9. Here an upwardly extended first profile 11 is provided enabling a much greater thickness of artwork/spacer/cover/backing to be accommodated.

Figure 10:
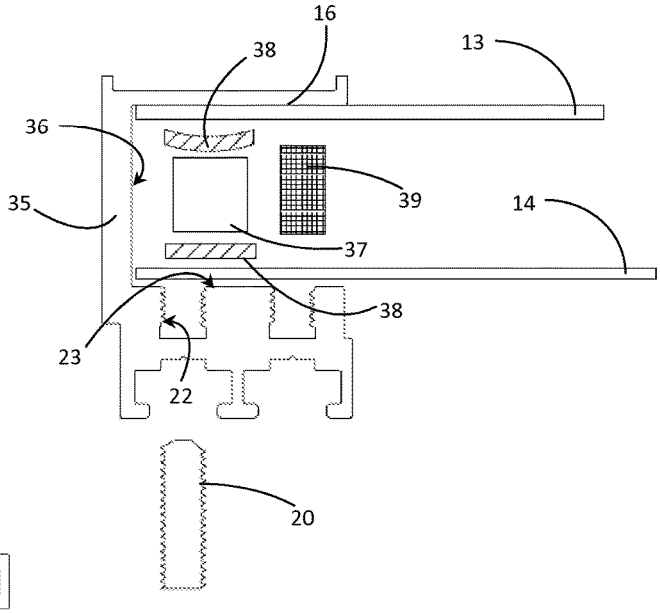
FIGS. 10 to 12 illustrate an alternative embodiment of the invention.
Figure 11:
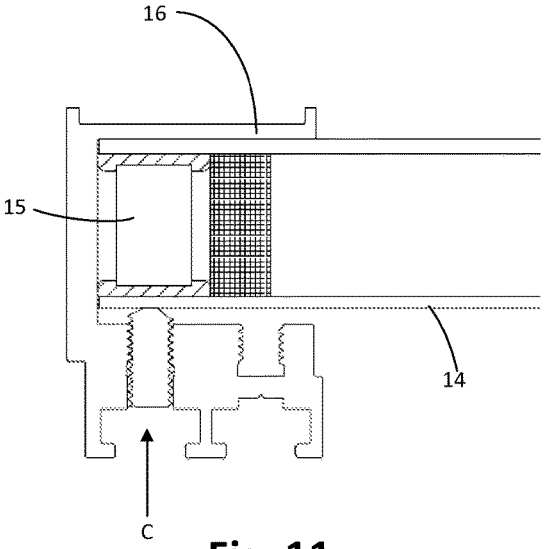
Figure 12:
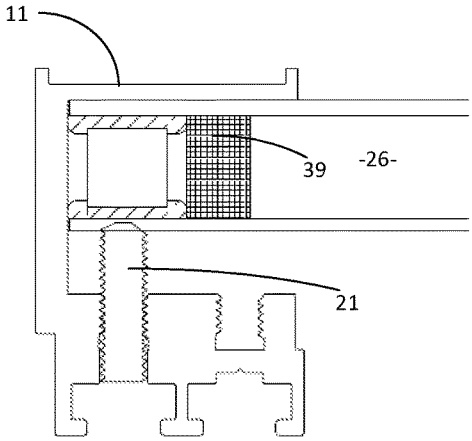

A complete alternative embodiment is illustrated by FIGS. 10 to 12 wherein only a single profile type 35 is necessary. Such a profile effectively forms a channel 36 into which the cover and backing sheets 13 and 14 respectively can be located, in addition to a continuous seal. In the illustrated form, the continuous seal 15 is comprised of a hard core 37 such as an aluminium frame, sandwiched between two resilient layers 38, e.g. Viton® synthetic rubber. A further internal wall 39, e.g. of Plastazote® foam, may be employed which could be a further seal or a protective layer or merely packing material between the artwork and the edge of the frame for conveniently locating it.

In one form, the core 37 may have a sealant applied on each side by a caulk gun as described previously. The sealant can be set on the spacer core 37 and cured against the glass or other sheet material using a releasing agent such as petroleum jelly or vacuum grease. This embodiment is intended to give a smooth surface able to be compressed by the frame mechanism to create an airtight seal. The sealant can also be used to seal the corners of the spacer 37 should this be needed.

Profile 35 features flanges, equivalent to flanges 16 and 23 from the first embodiment described above, that accommodate the cover/seal/backing sandwich arrangement. The width of channel 36 is chosen dependent on the combined thickness to be accommodated or vis-a-versa. In the illustrated form a fastening member 21 is introduced through an opening in the rear of profile member 35, into a corresponding thread, to directly contact backing sheet 14. However, alternative forms may feature an intermediate contact surface to avoid direct and damaging pressure on the sheet 14; for example a metal or other rigid plate length could facilitate more even pressure enabling compression of the seal.

Alternative forms could utilise a fastener element through the frontal portion of frame profile 35. Such an arrangement could also include a veneer to be located upon flange 16.

FIGS. 11 and 12 show that different thicknesses of cover/spacer/artwork/backing can be accommodated by the same profile dependent upon how far the fastener (screw 21) is tightening into thread 22 in the direction of arrow C and/or by using a longer screw (FIG. 12). This simple adaptability avoids the need for multiple profile cross sections to be produced.

It will be apparent that concepts from both embodiments can be combined as needed. For example, two profile lengths could be mated (as in the first embodiment of FIG. 1) along with an additional compression screw (FIG. 10, etc.) to fine tune adjustment of the compression seal. Likewise, while atmosphere adjustment means is not illustrated in FIGS. 10 to 12 this can, of course, be present; as can corner elements 32. Alternative construction methods like the use of a sealant gun to deposit a seal material are applicable to both embodiments.

Both embodiments share the common feature of an extruded profile length being utilised together with a fastener to sandwich together under, preferably adjustable, compression several components which enclose an artwork. All components can be constructed from available materials and processes depending on economic and time constraints.

What I claim is:

1. A method for constructing a picture frame, including:
cutting to size first and second cooperating profile lengths to form a frame of a required dimension;
providing a cover sheet to fit within the frame;
providing a backing sheet to fit within the frame;
providing a continuous spacer locatable between the cover sheet and backing sheet to form a border within which an article can be mounted;
fastening together the first and second cooperating profile lengths by use of an adjustable fastener disposed through the first and second cooperating profile lengths at edges of the frame;
thereby adjustably compressing the spacer between the cover sheet and backing sheet; and
including an oxygen reducer.

2. The method of claim 1 wherein at least one of the profile lengths includes a contact surface that overlaps against the cover sheet.

3. The method of claim 2 wherein the continuous spacer is located to be hidden underneath the overlapped contact surface such that it is not visible when viewed frontally through the cover sheet.

4. The method of claim 1 wherein each profile length includes a mating surface for locating the pair of profile lengths together.

5. The method of claim 1 wherein the adjustable fastener is a screw or bolt.

6. The method of claim 5 wherein a screw head of the adjustable fastener is accessible from either a front of the profile, adjacent the cover sheet, or a rear of the profile, adjacent the backing sheet.

7. The method of claim 5 wherein the adjustable fastener is received by a threaded channel in the profile.

8. The method of claim 1 wherein the first and second cooperating profile lengths are extrusions or profiles of wood.

9. The method of claim 1 wherein the continuous spacer is a closed shape formed of compressible seal material, or a solid material with two seal faces, for sandwiching between the cover sheet and the backing sheet.

10. The method of claim 1 wherein the oxygen reducer is a scavenger material placed in an internal volume prior to seal compression, or located within a flexible bag associated with an opening in the backing sheet.

11. A method for constructing a picture frame, including:
cutting to size first and second cooperating profile lengths to form a frame of a required dimension;

providing a cover sheet to fit within the frame;

providing a backing sheet to fit within the frame;

providing a continuous spacer locatable between the cover sheet and backing sheet to form a border within which an article can be mounted;

fastening together the first and second cooperating profile lengths by use of an adjustable fastener disposed through the first and second cooperating profile lengths at edges of the frame;

thereby adjustably compressing the spacer between the cover sheet and backing sheet; and incorporating a pressure equalizer into the backing sheet.

12. The method of claim 11 wherein at least one of the profile lengths includes a contact surface that overlaps against the cover sheet.

13. The method of claim 11 wherein each profile length includes a mating surface for locating the pair of profile lengths together.

14. The method of claim 11 wherein the continuous spacer is located to be hidden underneath the overlapped contact surface such that it is not visible when viewed frontally through the cover sheet.

15. The method of claim 11 wherein the adjustable fastener is a screw or bolt.

16. The method of claim 15 wherein:

a screw head of the adjustable fastener is accessible from either a front of the profile, adjacent the cover sheet, or a rear of the profile, adjacent the backing sheet; or the adjustable fastener is received by a threaded channel in the profile.

17. The method of claim 1 wherein the oxygen reducer includes at least one valve in the backing sheet, or through the spacer, for the introduction of an inert gas or a specifically formulated gas.

18. The method of claim 1 wherein the cover sheet is provided with a recessed portion for accommodating a thick artwork.

19. The method of claim 1 further comprising including at least one of the first and second cooperating profile lengths with a contact surface that overlaps against the backing sheet.

20. A picture frame comprising:

at least one profile length to form a frame of a required dimension;

a cover sheet to fit within the frame;

a backing sheet to fit within the frame;

a continuous spacer locatable between the cover sheet and the backing sheet to form a border within which an article can be mounted, the continuous spacer being compressed between the cover sheet and the backing sheet with a fastener disposed through the profile length; and wherein the at least one profile length includes two opposing surfaces for receiving the cover sheet, the backing sheet and the continuous spacer therebetween, and wherein the fastener passes through one of the two opposing surfaces to enable compression of the spacer between the cover sheet and backing sheet.

* * * * *